US009404300B1

(12) United States Patent
Ramsdell

(10) Patent No.: US 9,404,300 B1
(45) Date of Patent: Aug. 2, 2016

(54) HINGE AND APPLICATIONS THEREOF

(71) Applicant: Wayne W. Ramsdell, South Sioux City, NE (US)

(72) Inventor: Wayne W. Ramsdell, South Sioux City, NE (US)

( * ) Notice: Subject to any disclaimer, the term of this patent is extended or adjusted under 35 U.S.C. 154(b) by 0 days.

(21) Appl. No.: 14/697,710

(22) Filed: Apr. 28, 2015

(51) Int. Cl.
*E05D 11/08* (2006.01)
*E05D 3/02* (2006.01)

(52) U.S. Cl.
CPC ..... *E05D 11/082* (2013.01); *E05D 3/02* (2013.01)

(58) Field of Classification Search
CPC ..... Y10T 16/54033; Y10T 16/54034; Y10T 16/540345; Y10T 16/54038; E05D 11/08; E05D 11/081; E05D 11/082; E05D 11/084; E05D 11/085; E05D 11/087; E05D 11/105; E05D 5/121; E05D 5/122; E05Y 2201/21; E05Y 2201/49; E05Y 2201/416; E05Y 2201/25; G02C 2200/20; G06F 1/1681
See application file for complete search history.

(56) References Cited

U.S. PATENT DOCUMENTS 4,478,532 A * 10/1984 Puro ..... B25B 7/08 16/342
4,951,349 A * 8/1990 Dietrich ..... E05D 11/087 16/228
5,146,808 A * 9/1992 Hoshino ..... F16M 13/027 16/235
5,572,769 A * 11/1996 Spechts ..... E05C 17/045 16/337
5,653,001 A * 8/1997 Lane ..... E05C 17/045 16/340
5,682,645 A * 11/1997 Watabe ..... G06F 1/1681 16/338
5,937,482 A * 8/1999 Horng ..... G06F 1/1616 16/273
5,967,587 A * 10/1999 Collet ..... B60J 3/0239 16/342
6,085,388 A * 7/2000 Kaneko ..... G06F 1/1616 16/274
2001/0016969 A1 * 8/2001 Fujita ..... G06F 1/1616 16/342

(Continued)

FOREIGN PATENT DOCUMENTS

DE 3002193 A1 * 7/1981 ..... G02C 5/2281
DE 19838820 A1 * 3/2000 ..... E05D 11/082
JP 2013002593 A * 1/2013

OTHER PUBLICATIONS

"Brake Lining Material: M9010-1", Product Data Sheet, Raybestos Products, Raymark Friction Company, Manheim, Pennsylvania, date unknown.

*Primary Examiner* — Chuck Mah
(74) *Attorney, Agent, or Firm* — Jeffrey A. Proehl; Woods, Fuller, Shultz & Smith, PC

(57) ABSTRACT

A hinge structure may comprise a first assembly including a central post with an outer surface and a first connector element on the central post for mounting on a first structure, a second assembly pivotally coupled to the first assembly and including a ring extending about the central post, a ring connector connected to the ring, and a second connector element on the ring for mounting on a second structure. A braking element may apply a selectable amount of resistance to pivot movement of the second connector element with respect to the first connector element and including a friction pad extending about a portion of the central post, a pressure band for pressing the friction pad against the central post, and a connecting structure connecting the ends of the band and being adjustable to move the ends closer toward each other and to relax the ends away from each other.

20 Claims, 6 Drawing Sheets

(56) References Cited

U.S. PATENT DOCUMENTS

2003/0140456 A1* 7/2003 Hsieh ..... G06F 1/1681 16/340
2004/0134033 A1* 7/2004 Raines ..... G02B 27/0149 16/342
2005/0108854 A1* 5/2005 Lee ..... F16M 11/10 16/340
2010/0064477 A1* 3/2010 Wang ..... G06F 1/1681 16/297
2010/0139040 A1* 6/2010 Shen ..... G06F 1/1616 16/250
2011/0047748 A1* 3/2011 Chien ..... H04M 1/0216 16/250
2011/0099761 A1* 5/2011 Wang ..... G06F 1/1681 16/339
2016/0010375 A1* 1/2016 Rittenhouse ..... E05D 11/082 361/679.27

* cited by examiner

HINGE AND APPLICATIONS THEREOF

BACKGROUND

Field

The present disclosure relates to hinges and more particularly pertains to a new hinge for providing an adjustable degree of resistance to pivot movement between two structures.

SUMMARY

In one aspect, the present disclosure relates to a hinge structure for connecting a first structure to a second in a pivotal manner. The hinge structure may comprise a first assembly for mounting on a first structure, with the first assembly including a central post with an outer surface and a first connector element mounted on the central post. The first connector element may be configured to mount on the first structure. The hinge structure may also include a second assembly for mounting on a second structure, with the second assembly being pivotally coupled to the first assembly. The second assembly may include at least one ring extending about the central post, a ring connector connected to the at least one ring, and a second connector element mounted on the at least one ring. The second connector element may be configured to mount on the second structure. The hinge structure may further include a braking element configured to apply a selectable amount of resistance to pivot movement of the second connector element with respect to the first connector element. The braking element may be positioned between the first assembly and the second assembly. The braking element may comprise a friction pad extending about a portion of the central post in contact with the outer surface of the post, and a pressure band for pressing the friction pad against the central post, the pressure band extending about the central shaft of the first assembly and the ring connector of the second assembly, with the pressure band being elongated with opposite ends. The braking element may also include a connecting structure connecting the ends of the pressure band and being adjustable to move the ends of the pressure band closer toward each other and being adjustable to relax the ends away from each other.

In another aspect, the disclosure relates to a system that may comprise a first structure, a second structure, and a hinge structure connecting the first structure to the second structure in a pivotal manner. The hinge structure may comprise a first assembly for mounting on a first structure, with the first assembly including a central post with an outer surface and a first connector element mounted on the central post. The first connector element may be mounted on the first structure. The hinge structure may also include a second assembly for mounting on a second structure, with the second assembly being pivotally coupled to the first assembly. The second assembly may include at least one ring extending about the central post, a ring connector connected to the at least one ring, and a second connector element mounted on the at least one ring. The second connector element may be mounted on the second structure. The hinge structure may further include a braking element configured to apply a selectable amount of resistance to pivot movement of the second connector element with respect to the first connector element. The braking element may be positioned between the first assembly and the second assembly. The braking element may comprise a friction pad extending about a portion of the central post in contact with the outer surface of the post, and a pressure band for pressing the friction pad against the central post, the pressure band extending about the central shaft of the first assembly and the ring connector of the second assembly, with the pressure band being elongated with opposite ends. The braking element may also include a connecting structure connecting the ends of the pressure band and being adjustable to move the ends of the pressure band closer toward each other and being adjustable to relax the ends away from each other.

In still another aspect, the disclosure is directed to a hinge structure for connecting a first structure to a second in a pivotal manner. The hinge structure ay comprise a first assembly for mounting on the first structure, with the first assembly having a first compression surface and a first connector element associated with the first compression surface. The first connector element may be configured to mount on the first structure, and a first pivot aperture may extend through the first compression surface. The hinge structure may also include a second assembly for mounting on the second structure, with the second assembly having a second compression surface positioned in opposition to the first compression surface of the first assembly and a second connector element associated with the second compression surface. The second connector element may be configured to mount on the second structure, and a second pivot aperture may extend through the second compression surface. The hinge structure may also comprise a braking element configured to apply a selectable amount of resistance to pivot movement of the second connector element with respect to the first connector element. The braking element may be positioned between the first assembly and the second assembly. The braking element may comprise a friction pad positioned between the first compression surface and the second compression surface, and the friction pad may be mounted to move with one surface of the first compression surface and the second compression surface. The hinge structure may also include a connector fastener pivotally connecting the second assembly to the first assembly. The connector fastener may extend through the first and second pivot apertures such that tightening of the connector fastener tends to move the first and second compression surfaces toward each other to compress the friction pad and increase resistance to pivot movement of the assemblies with respect to each other, and such that loosening of the connector fastener tends to permit movement of the first and second compression surfaces away from each other to decompress the friction pad and decrease resistance to pivot movement of the assemblies with respect to each other.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
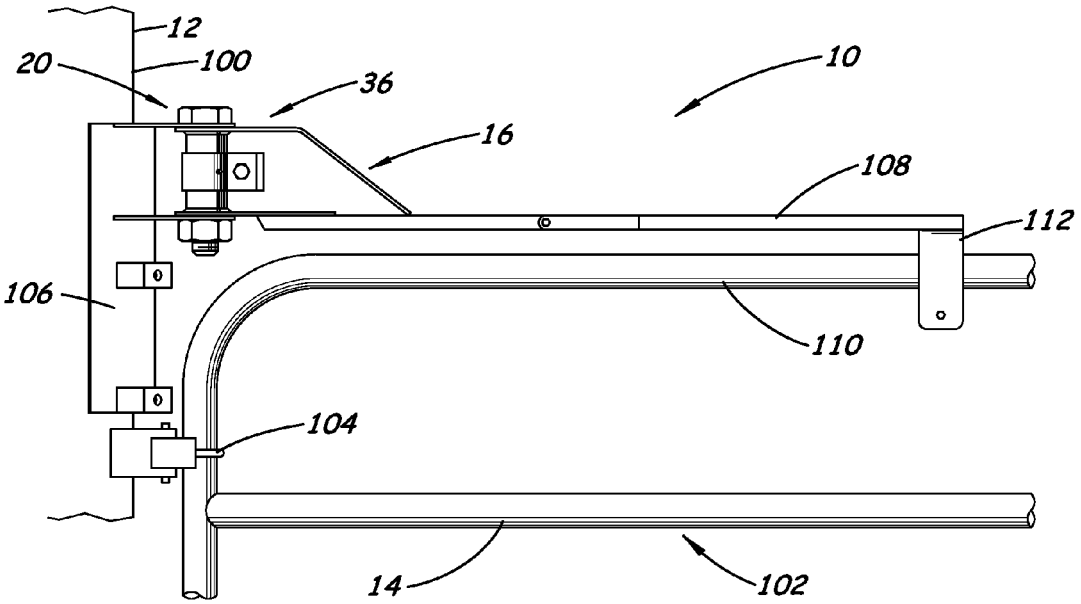
FIG. 1 is a schematic side view of an illustrative embodiment of a system including a new hinge structure according to the present disclosure.
Figure 2:
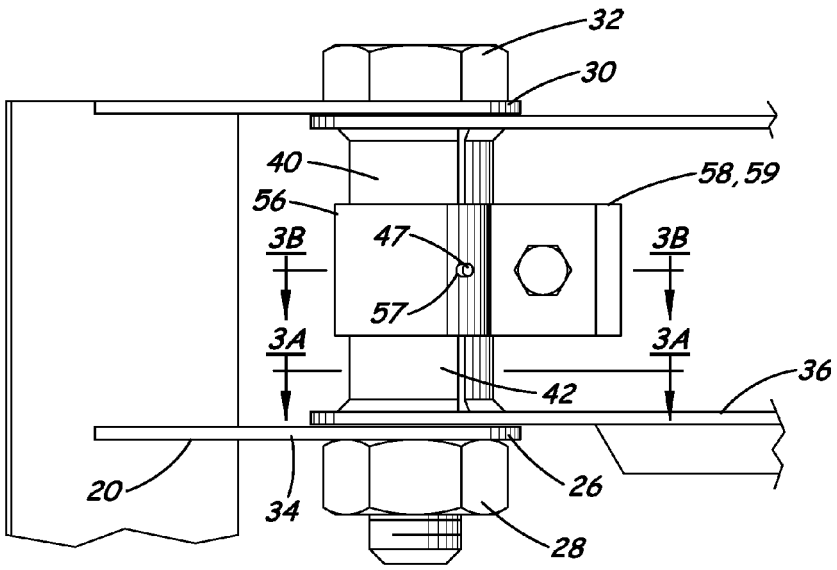
FIG. 2 is a schematic side view of the hinge structure, according to an illustrative embodiment.
Figure 3A:
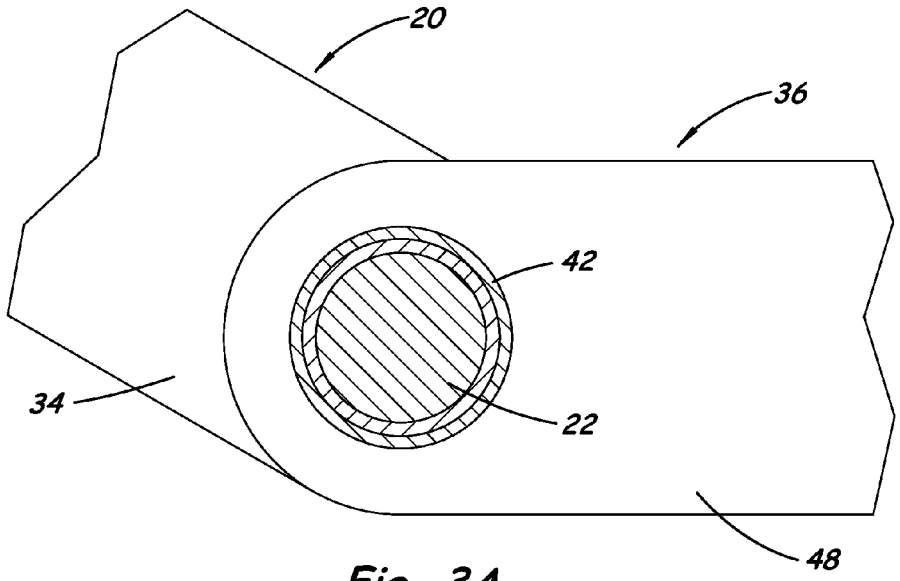
FIG. 3A is a schematic sectional view of the illustrative embodiment of the hinge structure shown in FIG. 2 taken along line 3A-3A.
Figure 3B:
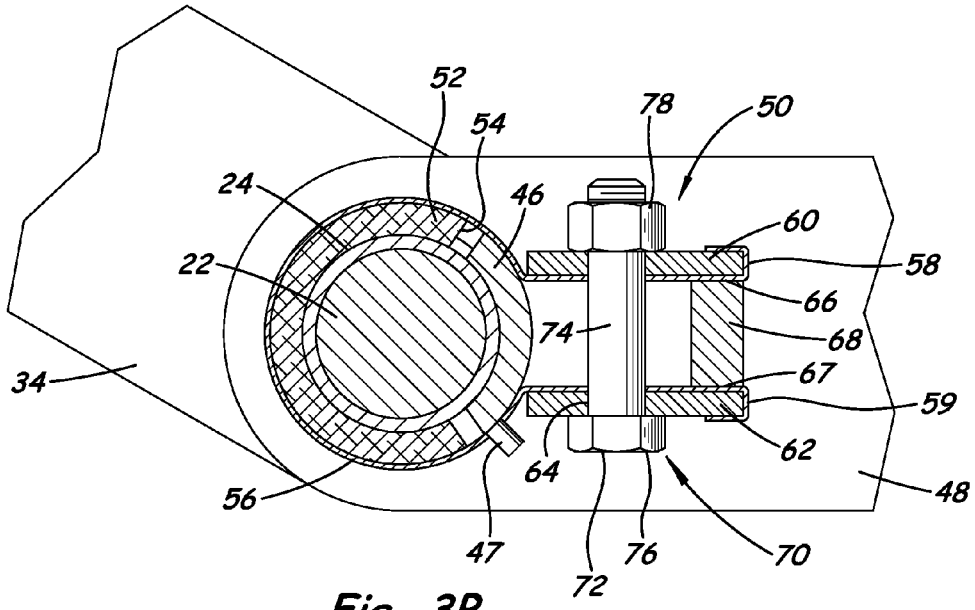
FIG. 3B is a schematic sectional view of the illustrative embodiment of the hinge structure shown in FIG. 2 taken along line 3B-3B.
Figure 4:
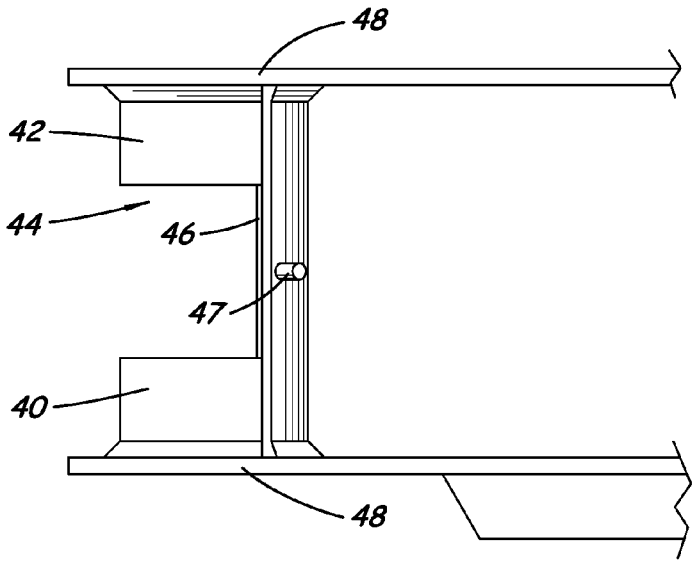
FIG. 4 is a schematic side view of a partially assembled hinge structure including elements of the second assembly of the hinge structure, according to an illustrative embodiment.
Figure 5:
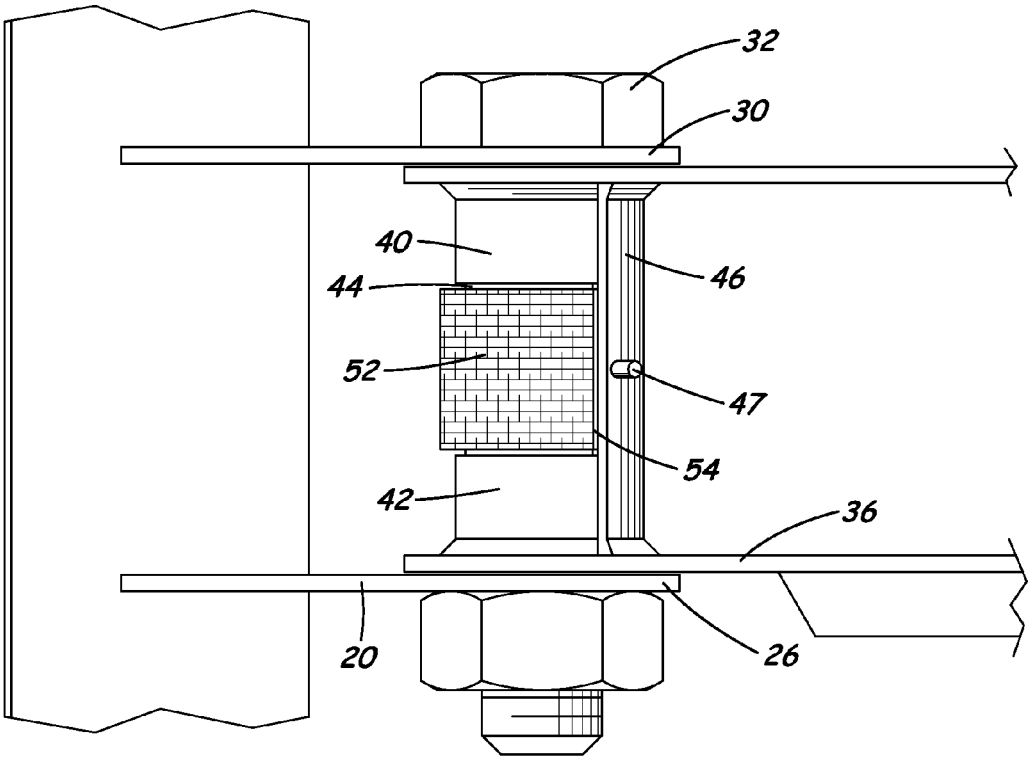
FIG. 5 is a schematic side view of a partially assembled hinge structure including elements of the first and second assemblies as well as the braking element the hinge structure, according to an illustrative embodiment.
Figure 6:
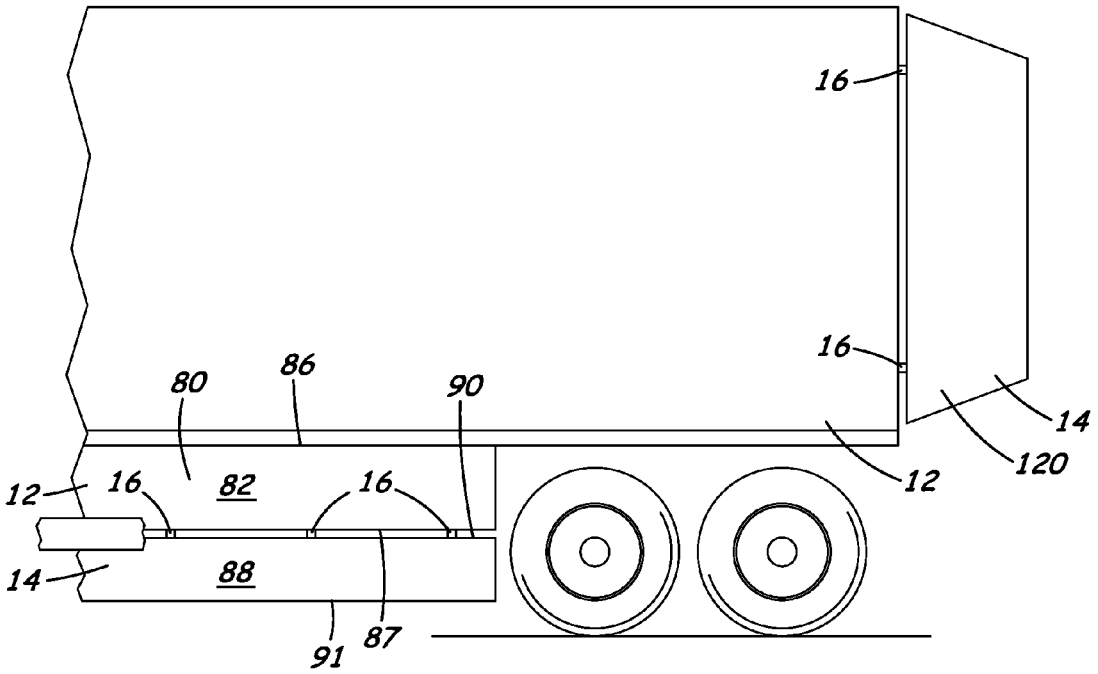
FIG. 6 is a schematic front side view of an aerodynamic panel system for a vehicle trailer utilizing the hinge structure, according to an illustrative embodiment.
Figure 7:
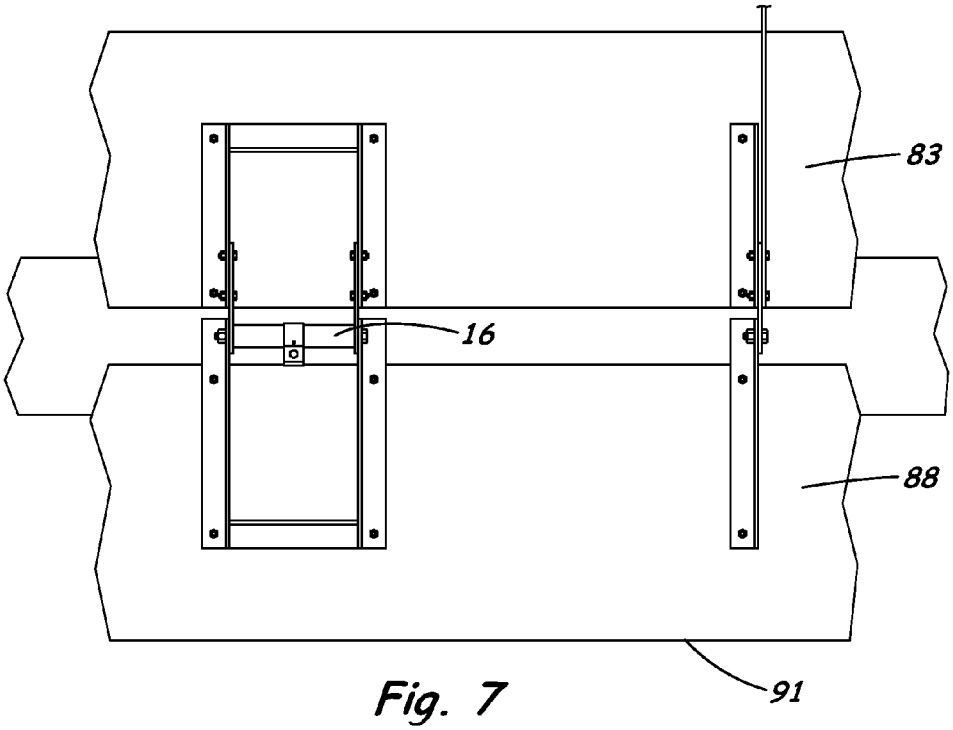
FIG. 7 is a schematic rear side view of the aerodynamic panel system for a vehicle trailer utilizing the hinge structure, according to an illustrative embodiment.
Figure 8:
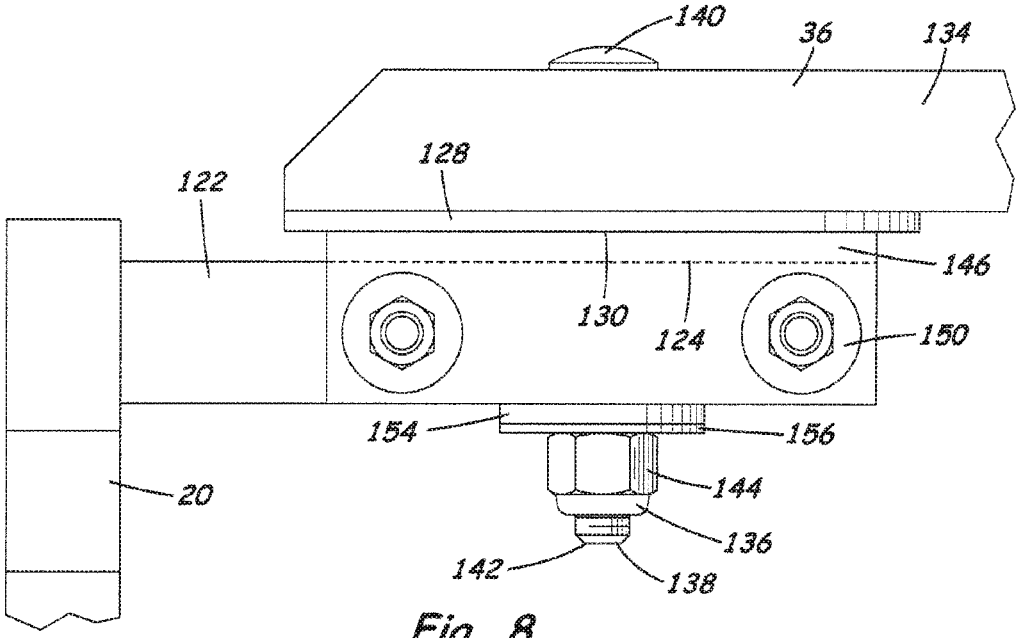
FIG. 8 is a schematic side view of another configuration of the hinge structure, according to an illustrative embodiment.
Figure 9:
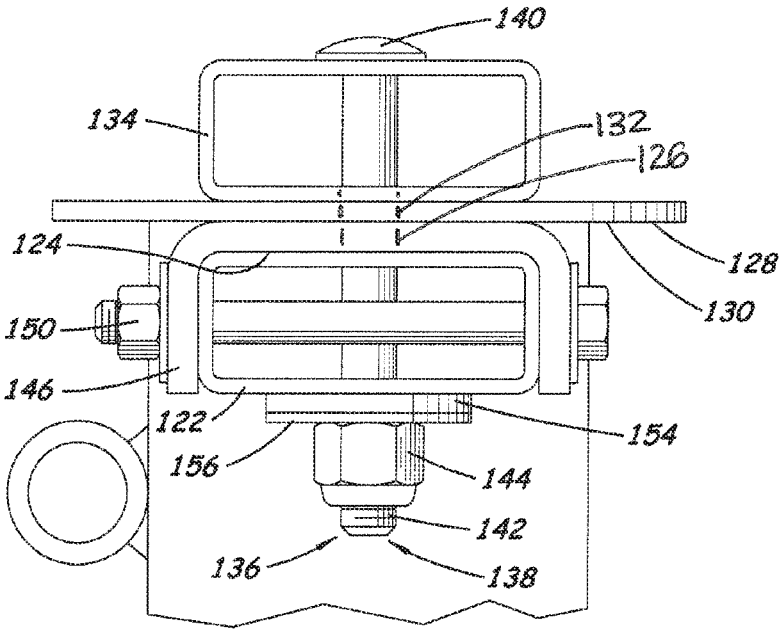
FIG. 9 is a schematic cross sectional view of the configuration of FIG. 8, according to an illustrative embodiment.
Figure 10:
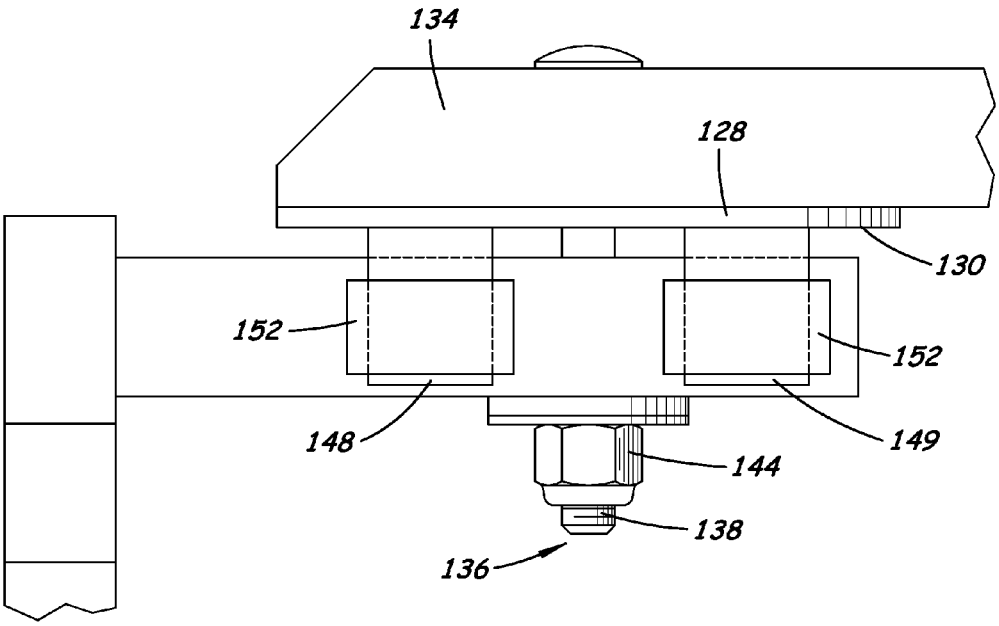
FIG. 10 is a schematic side view of a variation of the hinge structure of FIG. 8, according to an illustrative embodiment.
Figure 11:
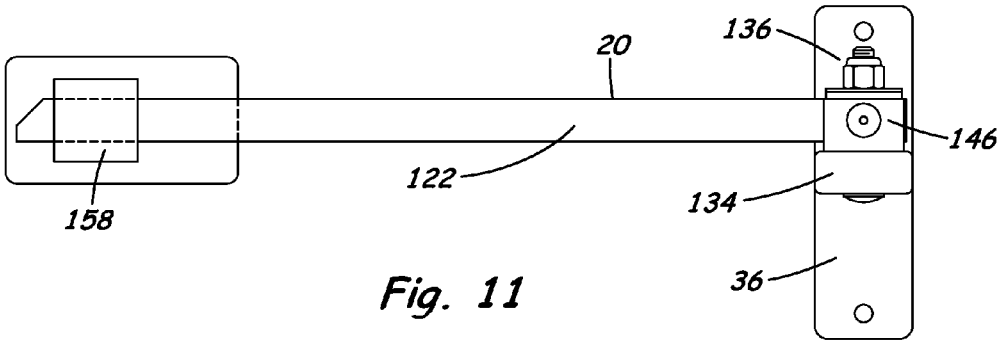
FIG. 11 is a schematic side view of another configuration of the hinge structure, according to an illustrative embodiment.

With reference now to the drawings, and in particular to FIGS. 1 through 11 thereof, a new hinge embodying the principles and concepts of the disclosed subject matter will be described.

In some aspects, the disclosure relates to a hinge structure 16 providing an adjustable degree of resistance to pivot movement between two structures, and in other aspects the disclosure relates to a system 10 that generally includes the hinge structure 16 as well as a first 12 and a second 14 structure with the hinge structure 16 connecting the first and second structures together to permit pivot movement of the structures 12, 14 with respect to each other. The hinge structure 16 may be adjustable to provide an adjustable degree of resistance to the relative pivot movement of the structures 12, 14 with respect to each other. In some embodiments, the hinge may be adjustable to provide substantially no resistance to the relative pivot movement to substantially complete resistance to the relative pivot movement. The adjustability of the degree of resistance to pivot movement may be virtually infinite in that there may not be discrete degrees or increments of resistance provided by the hinge structure 16, and rather the degree of resistance can be varied along a continuum.

The hinge structure 16 may include a first assembly 20 which is configured to be attached to or mounted on one of the structures 12, 14. In the illustrative embodiments shown in FIGS. 1 through 5, for example, the first assembly 20 may include a central post 22 with an outer surface 24 and with a bottom 28 and a top 32. In some embodiments, the central post 22 may be formed by a bolt and nut or nuts, or other fastener. The first assembly 20 may also include a bottom retainer member 26 mounted on the central post toward the bottom 28 and a top retainer member 30 mounted on the central post toward the top 32. The first assembly 20 may further include a first connector element 34 which is mounted on the central post, and the first connector element may be configured to mount on one of the structures 12, 14. The first connector element 34 may be configured to move as a unit with the post 22, such that connector element 34 rotates with the post.

The hinge structure 16 may also include a second assembly 36 which is configured to be attached to the other one of the structures 12, 14 which is not attached to the first assembly 20. The second assembly 36 may be pivotably coupled to the first assembly 20 such that the assemblies 20, 36 are able to move pivotally with respect to each other. The range of pivot movement of the second assembly with respect to the first assembly may be up to approximately 180 degrees or more. In the illustrative embodiments shown in FIGS. 1 through 5, the second assembly 36 may include at least one ring extending about the central post 22, and in some embodiments includes a pair of rings including a first ring 40 and a second ring 42 with each of the rings extending about the central post. The first and second rings may be spaced from each other along a longitudinal axis of the central post to thereby form a gap 44 between the first 40 and second 42 rings. A ring connector 46 may connect the first and second rings together with the connector 46 bridging between the first and second rings across the gap between the rings. The ring connector may be elongated in a direction substantially parallel to the longitudinal axis of the post 22, and may be curved in a lateral direction to fit more closed to the surface of the post. A positioning pin 47 may be mounted on the ring connector 46 and may extend radially outwardly from the surface of the ring connector. In some embodiments, the rings and ring connector are formed out of a single piece of material, although other separate pieces may be used to form the separate elements, and they may be connected together by some suitable method. The second assembly 36 may also include a second connector element 48 which is mounted on at least one of the rings. The second connector element 48 may be configured to mount on the particular structure 12, 14 to which the second assembly is mounted. In some embodiments, the second connector element 48 may have an end portion that forms an aperture for receiving a portion of the post, and the end portion may be joined to one of the rings 40, 42. The second connector element may be bifurcated into two end portions with each of the end portions being attached to one of the rings 40, 42.

A braking structure 50 may be configured to apply the selectable amount of resistance to relative pivot movement of the structures 12, 14 with respect to each other. The braking structure may be positioned or located between the first assembly 20 and the second assembly 36 of the hinge structure. The braking structure may include a friction pad 52 extending about a portion of the central post and may be generally in contact with the outer surface 24 of the post. In some embodiments, the friction pad 52 may be substantially cylindrical in shape with a slit 54 forming a space between ends of the pad to permit constriction of the friction pad about the outer surface 24 of the central post. In some embodiment, the size of the slit between the ends is sufficient to accommodate the ring connector with room to permit constriction of the pad about the post. The friction pad 52 may be positioned in the gap 44 between the first 40 and second 42 rings of the second assembly 36. The friction pad 52 may be formed of a material having a relatively high coefficient of friction, such as material used for brake linings. A suitable material may have a degree of flexibility to facilitate wrapping of the material about the post in a manner that keeps the material in contact with the surface of the post. One illustrative material is available as a brake lining material under the product no. M9010-1 from Raymark Friction Company, 123 E Stiegel St., Manheim, Pa., 17545-1626, although other materials from other sources may also be suitable for forming the friction pad.

The braking structure may further include a pressure band 56 which is configured to press the friction pad against the outer surface of the central post, and the pressure band may extend about the central shaft in a generally cylindrical configuration. The pressure band 56 may be elongated with opposite ends which are positioned proximate to each other but may not form a complete cylindrical structure. The opposite ends may include a first end 58 and a second end 59. The braking structure 50 may also include at least one cinch plate 60 being mounted on one of the ends of the pressure band 56. In some embodiments, each of the opposite ends 58, 59 of the pressure band 56 have a cinch plate mounted thereon, with a first cinch plate 60 being mounted on the first end 58 and a second cinch plate 62 being mounted on the second end 59 of the pressure band. At least one of the cinch plates may have an aperture 64 formed therein, and each of the plates may have an aperture formed therein. The first 60 and second 62 cinch plates may have respective opposing faces 66, 67 that are generally oriented substantially parallel to each other. The end portions of the pressure band 56 may be positioned between the opposing faces 66, 67, and an aperture may be formed in the band in alignment with the aperture (or apertures) 64 in the cinch plates. Optionally, a section of the end portion of the band may be wrapped about an outer edge of one or both of the cinch plates. A hole 57 may be formed in the pressure band 56 and the hole may be positioned on the band to receive the positioning pin 47 to resist movement of the band about the post to facilitate alignment of the ends 58, 59 and the cinch plates 60, 62 generally with the ring connector to maximize the contact of the band with the friction pad 52.

The braking structure 50 may also include a spacer 68 which is positioned between the cinch plates to facilitate orientation of the opposing faces 66, 67 of the cinch plates in a substantially parallel orientation with respect to each other and in some embodiments to provide a fulcrum function to facilitate tightening of the band about the friction pad 52 and the post 22. In some embodiments, the spacer is mounted on one of the cinch plates 60, 62 and may be positioned adjacent to the aperture 64. The spacer 68 may be positioned on the cinch plate on an opposite side of the aperture from the pressure band 56, such as at the outer edge of the cinch plate.

The braking structure may also include a connecting structure 70 for connecting the ends of the pressure band together and may be adjustable to move the opposite ends 58, 59 of the band towards each other and also being adjustable to permit the ends to move away from each other such that the pressure applied by the pressure band to the friction pad 52 may be adjusted. In some embodiments, the connecting structure 70 includes a fastener 72 connecting the cinch plates together such that tightening of the fastener moves the cinch plates together as well as the end portions of the pressure band. Loosening of the fastener 72 may permit the cinch plates and the end portions of the band to move apart from each other. In the illustrative embodiments, the fastener 72 includes a shaft 74, a head 76 that is formed on the shaft 74, with at least a portion of the shaft being threaded. The fastener 72 may also include a nut 78 which is threaded on the shaft. The shaft of the fastener may pass through the aperture 64 of at least one of the cinch plates, but optionally passes through the apertures in both cinch plates 60, 62 as well as any apertures in the end portions of the band. Optionally, the fastener may be fixedly mounted to one of the cinch plates in a more permanent fashion, and the shaft 74 may pass through an aperture in the other one of the cinch plates. Other suitable means may be used to move the plates together, such as a clamping structure acting on the plates or the end portions of the band.

Other aspects of the disclosure regard the nature of the first 12 and second 14 structures that are connected by the hinge structure 16. Suitable applications for the hinge structure are numerous, as situations where a hinge with an easily adjustable degree of pivot resistance is advantageous.

One illustrative application for the hinge is the mounting of a panel on a vehicle for enhancing the aerodynamic characteristics of the vehicle. For example, panels may be added to the underside or the backside of a semi-trailer for aerodynamic advantage. However, such panels need to extend down close to the road surface for the maximum beneficial effect, such that also makes the panel vulnerable to damage from debris or snow on the roadway, high spots in the curb cuts of driveways or any other high spots in the ground surface over which the vehicle is traveling.

One highly advantageous solution to such challenges is to have a bifurcated panel assembly in which an upper panel is relatively rigidly connected to the underside of the trailer, and a lower panel is mounted to move with respect to the upper panel. Such an approach is most beneficial if the lower panel is not easily moved by lower levels of force, such as by the air pressure exerted on the panel during highway travel, but can be moved by the application of higher levels of force, such as by impact of roadway debris or a high spot in the road surface with the lower panel that might be capable of damaging the lower panel. The adjustable degree of resistance to pivot movement of the hinge of the disclosure may permit the lower panel in such an application to move in response to higher levels of force but not lower levels.

Illustratively, the first structure 12 may comprise an upper panel 80, which may be a relatively thin panel in thickness and may have a first face 82 and a second face 83 located opposite of the first face. The panel 80 may be oriented substantially vertically such that the faces are substantially vertical, and the first panel may also be substantially rigidly held in position. The first panel 80 may have a first edge 86 and a second edge 87 located opposite of the first edge, with the first edge 86 being located relatively higher, and may be adjacent to the underside of the semi-trailer bed, and the second edge 87 may be relatively lower. In such embodiments, the second structure 14 may comprise a lower panel 88 with an upper edge 90 positioned adjacent to the second edge 87 of the upper panel 80. A gap may be formed between the lower edge 87 of the upper panel and the upper edge 90 of the lower panel to facilitate movement of the lower panel with respect to the upper panel, and the gap may be covered by a flap connected to one of the panels but free to move with respect to the other of the panels.

The hinge structure 16 may be attached to the upper panel 80, such as at or adjacent to the second edge 87, and the lower panel 88, such as at or adjacent to the lower edge 91. The hinge structure may be mounted on the panels as a part of a bifurcated mounting frame, with the bifurcated portions of the frame being mounted on the upper and lower panels and the hinge structure being located at a pivot between the frame portions. One, or a combination of more than one, of the hinge structures may be mounted at the pivot between the frame portions to provide a suitable degree of resistance to pivot when adjusted. The hinge structure 16 may thus control the movement of the lower panel 88 with respect to the upper panel 80, and provide an adjustable degree of resistance to movement of the lower panel with respect to the upper panel. In this way the resistance may be adjusted so that air pressure acting on the lower panel does not move the lower panel, but contact of the lower panel with debris or the ground surface is able to move the lower panel out of the way of the object to minimize or prevent damage. Optionally, when the lower panel needs to be moved out of the way, such as to perform servicing on components on the underside of the trailer bed, the hinge structure can be adjusted (loosened) to permit the lower panel to be pivoted upwardly and then adjusted again (tightened) to hold the lower panel in a raised position, such as, for example, in an orientation substantially parallel to the ground surface. The lower panel can then be returned to a substantially vertical orientation after servicing has been completed.

In other applications, the hinge structure 16 may be advantageously utilized on a door or a pass-through gate to provide a degree of resistance in any tendency of the door or gate to swing shut (or open) without some assistance through force applied to the door or gate by a user. The door may be a door mounted on a building structure or on a vehicle or trailer, for example. The gate may be a pass-through gate on an agricultural or a residential or commercial fence. In such an application, the first structure may comprise a gate post 100 and the second structure may comprise a gate panel 102 to provide an adjustable degree of resistance of the pivot movement of the gate panel with respect to the gate post to facilitate holding the gate panel in an open condition, while passage through the gate opening is performed. The gate may be connected to the post by one or more primary hinges, and the hinge structure 16 may be utilized in addition to the primary hinge or hinges. The hinge structure may be mounted on the gate post by a mounting plate 106, which may have an angle configuration or a U-shaped configuration that extends about a portion of the circumference of the post. Illustratively, one or more fasteners may pass through holes in the plate and extend into the post to hold the plate 106 to the post. A gate arm 108 may be mounted on the gate panel 102, and may extend along a portion of the gate panel and may be mounted on one of the bars 110 of the gate. The arm 108 may terminate with a loop 112 that loops about the gate bar and functions to move with the gate or resist movement of the gate depending upon the adjustment of the hinge structure. The arm 108 may be mounted or otherwise attached to one of the first 34 and second 48 connector elements, and the mounting plate 106 may be mounted or otherwise connected to the other one of the first and second connector elements.

In yet another application, the hinge structure may be beneficially used in a system of aerodynamic panels mounted on the rear end of a semi-trailer to reduce aerodynamic drag. A panel 120 may be mounted on each lateral side of the rear end of the enclosed box of a semi-trailer to assist in the transitional flow of air behind the trailer as the trailer passes through the air during high-speed highway travel. The usefulness of the panels 120 is limited to times of highway travel, and during other periods of travel and during loading and unloading of the trailer it is desirable to move the panels into a position that is close to the trailer, such as against the rear cargo doors of the trailer. The hinge structure 16 may be used, alone or in combination with conventional hinges, to mount the panel to the cargo door or side wall of the trailer and may be moved outwardly from the surface of the trailer when higher speed travel is anticipated, and then returned to a position adjacent to the trailer surface for slower travel or loading/unloading of cargo. The pivot resistance of the hinge structure may be adjusted and increased to hold the panel in the operative position or the storage position, and then the resistance may be decreased to permit movement between the operative and storage positions.

Other embodiments of the hinge structure are possible, such as those shown in FIGS. 8 through 11, which are useful for the applications discussed above as well as other applications, such as adjustable door holders or stops. In such embodiments, the first assembly 20 comprises a first connector element 122 that may be connected to one of the structures 12, 14, and may have a first compression surface 124 which may be generally planar in character. The first assembly 20 may also include a first pivot aperture 126 which may extend through the first compression surface 124, and may also extend through the first connector element 122. In some applications, the first compression surface 124 may be substantially horizontally oriented, and may be located on an upper surface (see e.g., FIG. 8) but may also be located on a lower surface (see e.g., FIG. 11). The first connector element 122 may comprise a bar for connecting to one of the structures 12, 14. In some embodiments a connector loop 158 may be mountable on one of the structures 12, 14, such as a door of an enclosure, to receive a portion of the connector element 122.

The second assembly 36 of the hinge structure may include a plate 128 having a second compression surface 130 which may be substantially planar in character and may be formed on a lower surface of the plate. The plate 128 may be substantially circular (although other suitable shapes could be used) and may being substantially horizontally oriented with the second compression surface also being substantially horizontally oriented. A second pivot aperture 132 may extend through the plate 128 and through the second compression surface 130. A second connector element 134 may be mounted on the plate 128, and in some embodiments the second connector element may be positioned adjacent to an upper surface of the plate. The second pivot aperture 132 may extend through the second connector element 134.

A connector fastener 136 may pass through the first pivot aperture 126 of the first assembly and the second pivot aperture 132 of the second assembly to pivotally connect the first connector element 122 to the plate 128 and the second connector element 134. In some embodiments, the connector fastener 136 may be tightened to bring these elements toward each other and may also be loosened to allow these elements to move apart. The connector fastener 136 may comprise a bolt 138 with a head 140 and shaft 142 with a threaded portion, and a nut 144 may be threaded onto the threaded portion of the shaft 142. In some embodiments, a compressible washer 154 may be positioned about the shaft 142 for being pressed against the elements connected by the connector fastener 136 to bias the elements together, and a rigid washer 156 may also be employed to facilitate the application of pressure to the compressible washer.

In embodiments such as shown in FIGS. 8 through 11, the braking element may comprise a friction pad 146 may positioned between the first compression surface 124 and the second compression surface 130, and in some embodiments the friction pad is mounted on or otherwise attached to the first connector element 122 to move with the element 122. In some of the illustrative embodiments (see e.g., FIGS. 8 through 10), the friction pad 146 may include a pair of friction strips 148, 149, and the friction strips may be positioned on opposite sides of the shaft 142 of the connector fastener. In other illustrative embodiments (see e.g., FIG. 11), the connector fastener may pass through the friction pad 146. In some embodiments, the friction pad, or strips, may be mounted on the first connector element 122 by a fastener 150 which may pass through a portion of the friction pad or strips, and a portion of the first connector element 122. In other embodiments, the friction pad or strips may be mounted on the first connector element 122 by one or more loops 152, with the loop or loops being mounted on the first connector element and receiving a portion of the friction pad or strip extending through the loop or loops.

It will be appreciated that the tightening of the connector fastener 136 tends to move the first 124 and second 130 compression surfaces towards each other with the friction pad or strips being positioned therebetween and the tightening functions to compress the friction pad or strips to enhance the degree of friction between the friction pad and the second compression surface (as the friction pad moves with the first compression surface) and thus adds a degree of restriction to pivot movement of the assemblies 20, 36 with respect to each other. Conversely, loosening the connector fastener tends to decrease the compression of the friction pad and correspondingly decreases the degree of friction between the friction pad and the second compression surface and thus permits freer pivot movement of the assemblies 20, 36 with respect to each other.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

I claim:

1. A hinge structure for connecting a first structure to a second structure in a pivotal manner, the hinge structure comprising:

a first assembly for mounting on a first structure, the first assembly including a central post with an outer surface and a first connector element mounted on the central post, the first connector element being configured to mount on the first structure;

a second assembly for mounting on a second structure, the second assembly being pivotally coupled to the first assembly, the second assembly including at least one ring extending about the central post, a ring connector connected to the at least one ring, and a second connector element mounted on the at least one ring, the second connector element being configured to mount on the second structure; and a braking element configured to apply a selectable amount of resistance to pivot movement of the second connector element with respect to the first connector element, the braking element being positioned between the first assembly and the second assembly, the braking element comprising:

a friction pad extending about a portion of the central post in contact with the outer surface of the post;

a pressure band for pressing the friction pad against the central post, the pressure band extending about the central post of the first assembly and the ring connector of the second assembly, the pressure band being elongated with opposite ends; and a connecting structure connecting the ends of the pressure band and being adjustable to move the ends of the pressure band closer toward each other and being adjustable to relax the ends away from each other.

2. The hinge structure of claim 1 wherein the braking element additionally comprises a cinch plate mounted on each of the ends of the pressure band, the connecting structure being mounted on the cinch plates.

3. The hinge structure of claim 2 wherein the braking element additionally comprises a spacer positioned between the cinch plates to form a partial fulcrum between the plates.

4. The hinge structure of claim 2 wherein the connecting structure comprises a fastener connecting the cinch plates such that tightening of the fastener moves the cinch plates together and loosening the fastener permits the cinch plates to move apart.

5. The hinge structure of claim 4 wherein the fastener has a shaft at least partially threaded, a head formed on the shaft, and a nut threaded on the shaft that is tightenable to bring the cinch plates toward each other and decrease the effective circumference of the pressure band.

6. The hinge structure of claim 5 wherein at least one of the cinch plates has an aperture, and the shaft of the fastener passes through the at least one aperture.

7. The hinge structure of claim 1 wherein the at least one ring comprises a first ring and a second ring each extending about the central post, the first and second rings being spaced from each other along a longitudinal axis of the central post with a gap being formed between the first and second rings, the friction pad being positioned in the gap.

8. The hinge structure of claim 7 wherein the ring connector connects the first and second rings together across the gap.

9. The hinge structure of claim 1 wherein the braking element additionally comprises a cinch plate mounted on each of the ends of the pressure band, the connecting structure being mounted on the cinch plates; and wherein the braking element additionally comprises a spacer positioned between the cinch plates to form a partial fulcrum between the plates.

10. A system comprising:

a first structure;

a second structure; and a hinge structure connecting the first structure to the second structure in a pivotal manner, the hinge structure comprising:

a first assembly mounted on the first structure, the first assembly including a central post with an outer surface and a first connector element mounted on the central post, the first connector element being mounted on the first structure;

a second assembly mounted on the second structure, the second assembly being pivotally coupled to the first assembly, the second assembly including at least one ring extending about the central post, a ring connector connected to the at least one ring, and a second connector element mounted on the at least one ring, the second connector element being mounted on the second structure; and a braking element configured to apply a selectable amount of resistance to pivot movement of the second connector element with respect to the first connector element, the braking element being positioned between the first assembly and the second assembly, the braking element comprising:

a friction pad extending about a portion of the central post in contact with the outer surface of the post;

a pressure band for pressing the friction pad against the central post, the pressure band extending about the central post of the first assembly and the ring connector of the second assembly, the pressure band being elongated with opposite ends; and a connecting structure connecting the ends of the pressure band and being adjustable to move the ends of the pressure band closer toward each other and being adjustable to relax the ends away from each other.

11. The system of claim 10 wherein the braking element additionally comprises a cinch plate mounted on each of the ends of the pressure band, the connecting structure being mounted on the cinch plates.

12. The system of claim 11 wherein the braking element additionally comprises a spacer positioned between the cinch plates to form a partial fulcrum between the plates.

13. The system of claim 11 wherein the connecting structure comprises a fastener connecting the cinch plates such that tightening of the fastener moves the cinch plates together and loosening the fastener permits the cinch plates to move apart.

14. The system of claim 13 wherein the fastener has a shaft at least partially threaded, a head formed on the shaft, and a nut threaded on the shaft that is tightenable to bring the cinch plates toward each other and decrease the effective circumference of the pressure band.

15. The system of claim 10 wherein the at least one ring comprises a first ring and a second ring each extending about the central post, the first and second rings being spaced from each other along a longitudinal axis of the central post with a gap being formed between the first and second rings, the friction pad being positioned in the gap.

16. The system of claim 10 wherein at least one of the structures comprises an aerodynamic panel.

17. The system of claim 10 wherein each of the structures comprises an aerodynamic panel.

18. The system of claim 10 wherein one of the structures comprises a gate post and another one of the structures comprises a gate panel.

19. The system of claim 10 wherein one of the structures comprises a semi trailer and another one of the structures comprises an aerodynamic panel.

20. A hinge structure for connecting a first structure to a second structure in a pivotal manner, the hinge structure comprising:

a first assembly for mounting on a first structure, the first assembly including a central post with an outer surface and a first connector element mounted on the central post, the first connector element being configured to mount on the first structure;

a second assembly for mounting on a second structure, the second assembly being pivotally coupled to the first assembly, the second assembly including at least one ring extending about the central post, a ring connector connected to the at least one ring, and a second connector element mounted on the at least one ring, the second connector element being configured to mount on the second structure; and a braking element configured to apply a selectable amount of resistance to pivot movement of the second connector element with respect to the first connector element, the braking element being positioned between the first assembly and the second assembly, the braking element comprising:

at least one friction pad positioned in contact with the outer surface of the central post;

a pressure band for pressing the at least one friction pad against the outer surface of the central post, the pressure band extending about the central post of the first assembly and the ring connector of the second assembly, the pressure band being elongated with opposite ends; and a connecting structure connecting the ends of the pressure band and being adjustable to move the ends of the pressure band closer toward each other and being adjustable to relax the ends away from each other.

* * * * *